US009644328B1

(12) United States Patent
Godbersen

(10) Patent No.: US 9,644,328 B1
(45) Date of Patent: May 9, 2017

(54) CONCRETE WHITETOPPING SYSTEM

(71) Applicant: GOMACO Corporation, Ida Grove, IA (US)

(72) Inventor: Gary L. Godbersen, Ida Grove, IA (US)

(73) Assignee: GOMACO Corporation, Ida Grove, IA (US)

( * ) Notice: Subject to any disclaimer, the term of this patent is extended or adjusted under 35 U.S.C. 154(b) by 0 days.

(21) Appl. No.: 14/466,038

(22) Filed: Aug. 22, 2014

Related U.S. Application Data

(60) Provisional application No. 61/870,329, filed on Aug. 27, 2013.

(51) Int. Cl.
*E01C 19/00* (2006.01)
*E01C 7/00* (2006.01)

(52) U.S. Cl.
CPC ..... *E01C 19/00* (2013.01); *E01C 7/00* (2013.01); *E01C 19/004* (2013.01)

(58) Field of Classification Search
CPC ..... E01C 7/00; E01C 19/00; E01C 19/004
USPC ..... 404/75, 82, 101, 105, 110, 84.05–84.2, 404/103, 118
See application file for complete search history.

(56) References Cited

U.S. PATENT DOCUMENTS 1,735,297 A * 11/1929 Pardue ..... 404/110
2,925,201 A * 2/1960 Peoples ..... 222/134
4,066,723 A * 1/1978 King et al. ..... 264/34
4,871,025 A * 10/1989 Mayfield et al. ..... 172/4.5
5,044,820 A * 9/1991 Prang ..... E01C 19/48 404/101
5,120,155 A * 6/1992 Samspon ..... 404/110
5,201,603 A * 4/1993 Bassett et al. ..... 404/84.1
5,232,305 A * 8/1993 Bassett et al. ..... 404/101
5,405,214 A * 4/1995 Campbell ..... 404/80
5,484,229 A * 1/1996 Reece ..... 404/110
5,553,969 A * 9/1996 Reed ..... 404/110
5,641,249 A * 6/1997 McClelland ..... 405/268
5,895,173 A * 4/1999 O'Brien et al. ..... 404/108
5,971,656 A * 10/1999 Kitsmiller ..... 404/74
6,203,244 B1 * 3/2001 Van Ornum ..... 404/110
6,345,931 B1 * 2/2002 Capece ..... 404/101
6,582,152 B2 * 6/2003 Leone et al. ..... 404/75
7,311,465 B2 * 12/2007 Guntert et al. ..... 404/105
7,686,537 B2 * 3/2010 Mullett ..... 404/101
8,113,736 B2 * 2/2012 Wilson, Sr. ..... 404/72
(Continued)

*Primary Examiner* — Raymond W Addie
(74) *Attorney, Agent, or Firm* — Suiter Swantz pc llo

(57) ABSTRACT

A system includes a mold configured for forming a paving material into a slab upon a surface, the mold including a width that is substantially perpendicular to a direction of travel of the mold; a mold positioning system coupled to the mold to control a position of the mold above the surface, the mold positioning system including at least one positioning element coupled to the mold to move at least a portion of the mold; and a transport unit including at least one portion configured to contact the surface, the transport unit including a rigid mount coupled to the mold positioning system to maintain a fixed spatial relationship between the transport unit and the mold positioning system, wherein the width of the mold is substantially greater than or equal to a maximum width of the at least one portion of the transport unit configured to contact the surface.

15 Claims, 9 Drawing Sheets

(56) References Cited

U.S. PATENT DOCUMENTS

| | | | | |
|---|---|---|---|---|
| 2003/0012603 | A1* | 1/2003 | Pont Feixes | E04F 21/24 404/118 |
| 2006/0002762 | A1* | 1/2006 | Crampton | 404/110 |
| 2009/0245937 | A1* | 10/2009 | Speers | E01C 19/48 404/101 |
| 2015/0003914 | A1* | 1/2015 | Steinhagen | E01C 19/48 404/118 |

* cited by examiner

CONCRETE WHITETOPPING SYSTEM

PRIORITY

The present application claims the benefit under 35 U.S.C. §119(e) of U.S. Provisional Application Ser. No. 61/870,329, filed Aug. 27, 2013, which is incorporated herein by reference.

FIELD OF THE INVENTION

The present disclosure generally relates to the field of paving equipment, and more particularly to a concrete whitetopping system for paving a surface with concrete.

BACKGROUND OF THE INVENTION

When paving a surface with a longitudinal slab of paving material, such as concrete, much of the lateral space around the pavement is occupied by equipment, such as portions of the paver (e.g., treads and/or wheels of the paver), vehicles for providing a supply of wet concrete, placers/spreaders, and the like. For a highway or street paving project, this occupied lateral space may require more than one lane closure to complete the paving project, which may lead to complete road closure or to undesirable congested traffic conditions in the remaining drivable lanes (if any).

Further, other pavement sites may include obstacles adjacent the surface to be paved which may hinder conventional paving systems. For instance, such obstacles may include fire hydrants, light posts, traffic signals, trees, electrical equipment, and the like which may pose logistical problems during the planning, preparation, and implementation phases of a pavement project.

Some asphalt paving equipment may permit paving a surface, where the bulk of the paving activity may be confined to the surface/lane to be paved, without excessive occupied lateral space. While such equipment may avoid some of the problems associated with requiring occupied lateral space, asphalt as a roadway surface incorporates many structural problems as compared to concrete construction, including, but not limited to, reduced effective lifetime, tendency to form potholes and ruts, and decreased skid resistance for most driving conditions including wet surfaces. Moreover, current asphalt pavers are not suitable for working with concrete, due in part to the use of the floating pan.

Consequently, it would be advantageous if an apparatus existed that is suitable for concrete paving a surface with minimal lateral space.

SUMMARY OF THE INVENTION

Accordingly, the present invention is directed to a novel method and apparatus for concrete paving a surface with minimal lateral space.

In one implementation of the present disclosure, a system includes a mold configured for forming a paving material into a slab upon a surface, the mold including a width that is substantially perpendicular to a direction of travel of the mold; a mold positioning system coupled to the mold, the mold positioning system configured for controlling a position of the mold above the surface, the mold positioning system including at least one positioning element coupled to the mold, wherein the at least one positioning element is configured to move at least a portion of the mold; and a transport unit configured for providing transport on the surface, the transport unit including at least one portion configured to contact the surface, the transport unit including a rigid mount coupled to the mold positioning system, the rigid mount configured to maintain a fixed spatial relationship between the transport unit and the mold positioning system, wherein the width of the mold is substantially greater than or equal to a maximum width of the at least one portion of the transport unit configured to contact the surface.

In a further implementation, a system includes a mold configured for forming a paving material into a slab upon a surface, the mold including a width that is substantially perpendicular to a direction of travel of the mold; a mold positioning system coupled to the mold, the mold positioning including a plurality of positioning elements coupled to the mold, each of the plurality of positioning elements being independently controllable to set at least one of a height of the mold above the surface, a long slope of the mold relative to the surface, or a cross slope of the mold relative to the surface; and a transport unit configured for providing transport on the surface, the transport unit including at least one portion configured to contact the surface, the transport unit including a rigid mount coupled to the mold positioning system, the rigid mount configured to maintain a fixed spatial relationship between the transport unit and the mold positioning system, wherein the width of the mold is substantially greater than or equal to a maximum width of the at least one portion of the transport unit configured to contact the surface.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the subject matter disclosed, which is illustrated in the accompanying drawings. The scope of the invention is limited only by the claims; numerous alternatives, modifications and equivalents are encompassed. For the purpose of clarity, technical material that is known in the technical fields related to the embodiments has not been described in detail to avoid unnecessarily obscuring the description.

Figure 1:
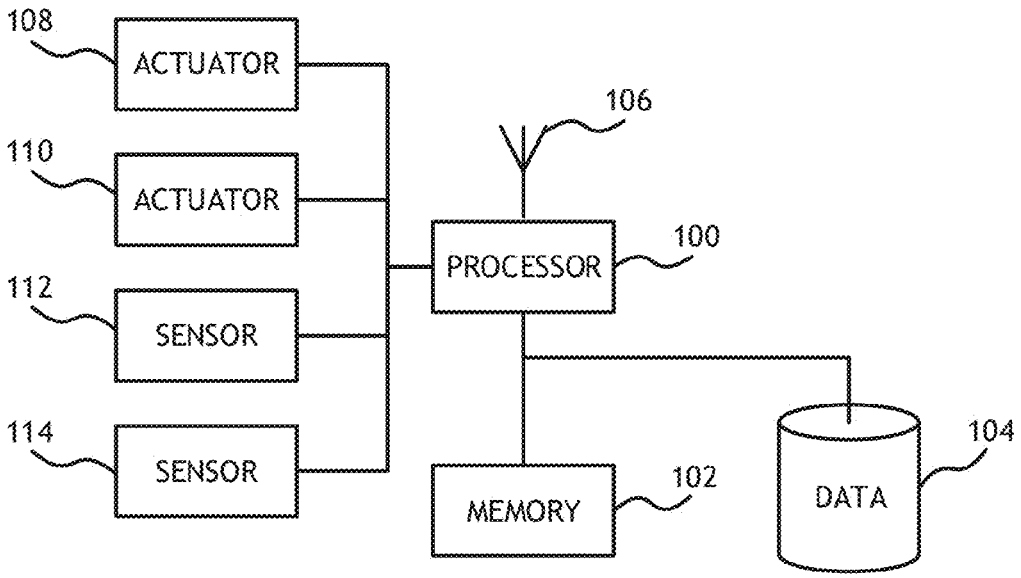
FIG. 1 shows a block diagram of a computer system for implementing embodiments of the present invention.

Referring to FIG. 1, a block diagram of a computer system for implementing embodiments of the present invention is shown. A paving system may include a computer system according to at least one embodiment of the present invention. The computer system may include a processor 100 connected to a memory 102 for storing computer executable program code, a data storage element 104 for storing a paving design profile and an antenna 106 for receiving location information, data related to a paving design profile, sensor data related to a newly paved surface or any other relevant data.

The processor 100 may be connected to a plurality of actuators 108, 110. A subset of the plurality of actuators 108, 110 may be configured to control the height of a mold attached to a mold positioning system. Furthermore, the subset of actuators 108, 110 may be independently controllable such that various distinct portions of the mold may be adjusted according to the actual contours of the surface being paved.

In at least one embodiment, one or more of the actuators 108, 110 may be configured to adjust the orientation of the mold positioning system with respect to a connected transport unit. Such adjustment may be within a limit range and within a single plane to maintain the mold positioning system on a track defined by the transport unit.

The processor 100 may receive data from one or more sensors 112, 114. The one or more sensors 112, 114 may include visual or sonic sensors for determining the quality of the paved surface. Additionally, the one or more sensors 112, 114 may include visual or sonic sensors for acquiring detailed measurements of the actual surface during paving operations so that such actual detailed measurements may be used to adjust the height and orientation of the mold. Although two sensors 112, 114 are shown, a person skilled in the art may appreciate that any number of appropriate sensors 112, 114 are conceived.

Figure 2:
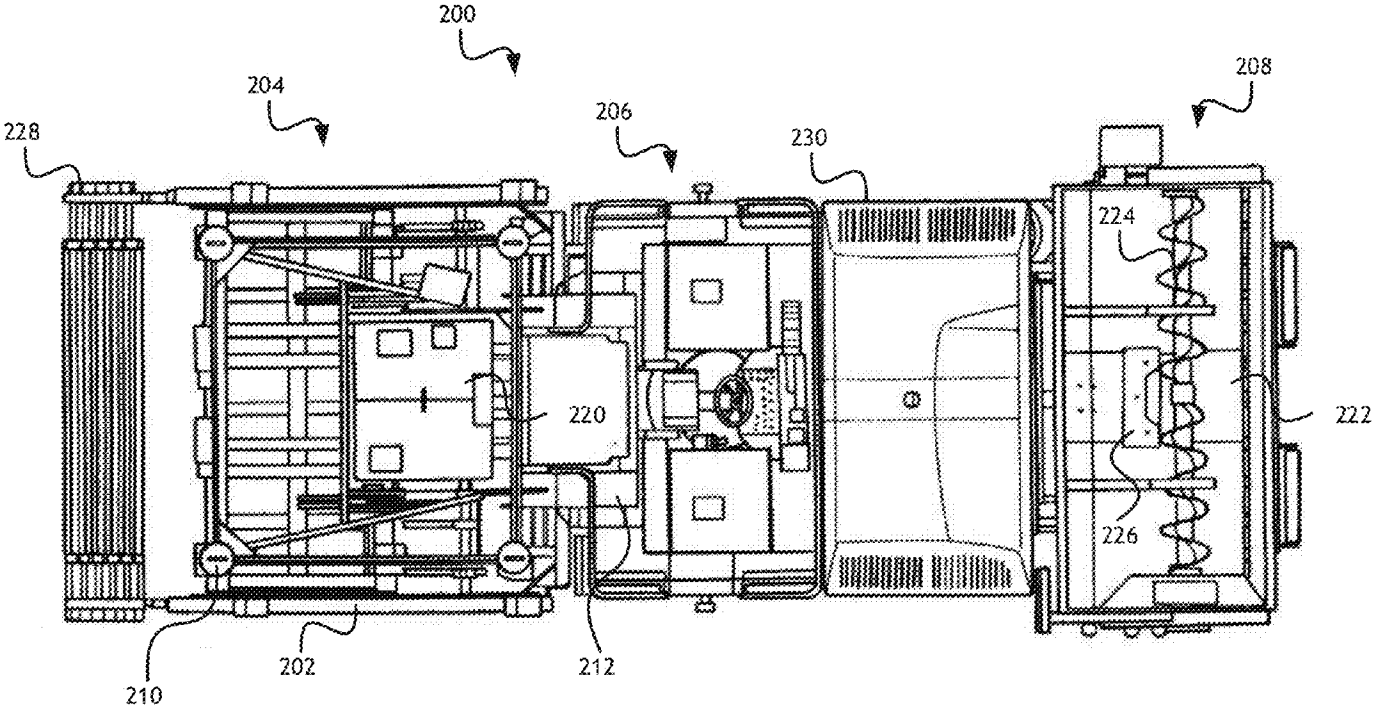
FIG. 2 shows a top plan view of an embodiment of a concrete whitetopping system according to the present invention.

Referring to FIG. 2, a top plan view of an embodiment of a concrete whitetopping system according to the present invention is shown. A concrete whitetopping system 200 may include a mold 202 whose position/orientation may be controlled by a mold positioning system 204 coupled to the mold 202. The concrete whitetopping system 200 may include a control unit 220 for controlling actuators, receiving location information and correlating location and orientation information received from various sources and sensors, and translating such information to manipulate the actuators and produce a paved surface according to a pacing profile.

The concrete whitetopping system 200 may also include a transport unit 206, to which the mold positioning system 204 is coupled, and a front bucket 208 for receiving a paving material. In general, operation of the concrete whitetopping system may include receiving a paving material (e.g., concrete) via the front bucket 208, transporting the paving material via a belt underneath the transport unit 206 to the mold 202, where the paving material may be placed and formed. The positioning of the front bucket 208 at the front of the transport unit 206 and of the mold 202 and mold positioning system 204 at the back of the transport unit, the concrete whitetopping system may generally avoid occupying lateral space around the surface to be paved. For instance, in a particular implementation, the width of the mold 202 may be the maximum width of the concrete whitetopping system 200 to thereby contain the concrete whitetopping system 200 to a width less than the width of a longitudinal slab of paving material formed by the mold 202. Such a configuration may permit paving of a surface with minimum clearance on the sides of the concrete whitetopping system 200.

The mold positioning system 204 may include one or more controllable positioning elements 210 for controlling a position and orientation of the mold 202 with respect to the surface to be paved. The mold positioning system 204 may be coupled to the transport unit 206 via a mold connecting element 212. In at least one embodiment, the mold connecting element 212 may be rigid such that the position of at least a portion of the mold positioning system 204 remains constant relative to the transport unit 206, with the mold 202 being moveable relative to each of the mold positioning system 204 and the transport unit 206 via the positioning elements 210.

In at least one embodiment, the controllable positioning elements 210 are substantially vertically-controlled hydraulic tubes, where four substantially vertically-controlled hydraulic tubes are coupled to a mold support from which the mold 202 is supported. The length of the controllable positioning elements 210 is controllable in a single direction, which, when oriented substantially upright, the positioning elements 210 are controllable in a direction substantially perpendicular to the surface to be paved. Each of the positioning elements 210 may be controlled independently such that the mold positioning system 204 may control each of the long slope of the mold 202, the cross slope of the mold 202, and the height of the mold 202 above the surface to be paved, wherein the position of the mold 202 relative to the surface to be paved controls the shape of the formed pavement on the surface. In other words, the mold 202 is not a floating mold pan, where the thickness of the paving material is controlled by draft determined by tracking arms, but rather the mold 202 is controlled directly by the positioning elements 210 of the mold positioning system 204. For instance, with an asphalt paver, by changing the amount of material deposited onto the surface for paving, depth variations in the pavement may occur due to the draft of the mold, tamping of the paving material, material density and composition, and the like. By utilizing a concrete paving material with the concrete whitetopping system 200, the thickness of the pavement is directly controlled by the positioning elements 210, whereby the positioning elements 210 may be maintained at a desired height (or variably controlled to conform to changing surface conditions, slope, and the like) to strike the paving material off to achieve a desired grade. The positioning elements 210 may be controlled via an on-board computing system, by an computing system located external to the concrete whitetopping system 200 (e.g., at a remote station), by user input via a user interface on the concrete whitetopping system 200, or by other suitable means.

The concrete whitetopping system 200 has been described as including an auger 214 for distributing the paving material across the width of the mold 202; it is also contemplated that other systems may be utilized to distribute the paving material across the width of the mold 202, including, but not limited to, one or more diverter plows or other suitable distribution system.

The transport unit 206 generally comprises components for providing transport of the concrete whitetopping system 200 such that the concrete whitetopping system 200 is suitable for transport on the surface to be paved. The transport unit 206 may also include one or more power elements 230 for providing power to the various systems (e.g., hydraulic, electrical, travel, vibrators, augers, conveyors, and the like) of the concrete whitetopping system 200.

In at least one embodiment, the concrete whitetopping system 200 may determine its location with reference to a previously positioned stringline (not shown) and make adjustments to one or more actuators (such as the positioning elements 210) based on the known location of such stringline. Furthermore, the control unit 210 may have a known paving profile defined with respect to the stringline, and make adjustments to the positioning elements 210 based on the paving profile and stringline location.

At least one of the transport unit 206 and the mold positioning system 204 may include location defining elements such as total station prisms or global positioning system satellite receivers. Such location defining elements may directly or indirectly supply a computer system with the relative or absolute location of the concrete whitetopping system 200 so that a computer may correlate the location and orientation of the concrete whitetopping system 200 in space to a known design profile.

The front bucket 208 may include a hopper 222 for receiving the paving material for introduction of the paving material to the concrete whitetopping system 200. The front bucket 208 may also include an auger 224 configured for directing the material received by the hopper into a conveyer opening 226 for transfer onto a conveyor system (obscured), which in turn transfers the material to the mold 202.

The mold positioning system 204 or mold 202 may also include a worker support platform 228. The worker support platform 228 may provide a surface upon which individuals may be supported above the freshly paved surface while working with the concrete whitetopping system 200 and/or the paved surface while the paving material is in a plastic state. Furthermore, instruments may be affixed to the worker support platform 228 for scanning the newly paved surface for defects.

Figure 3:
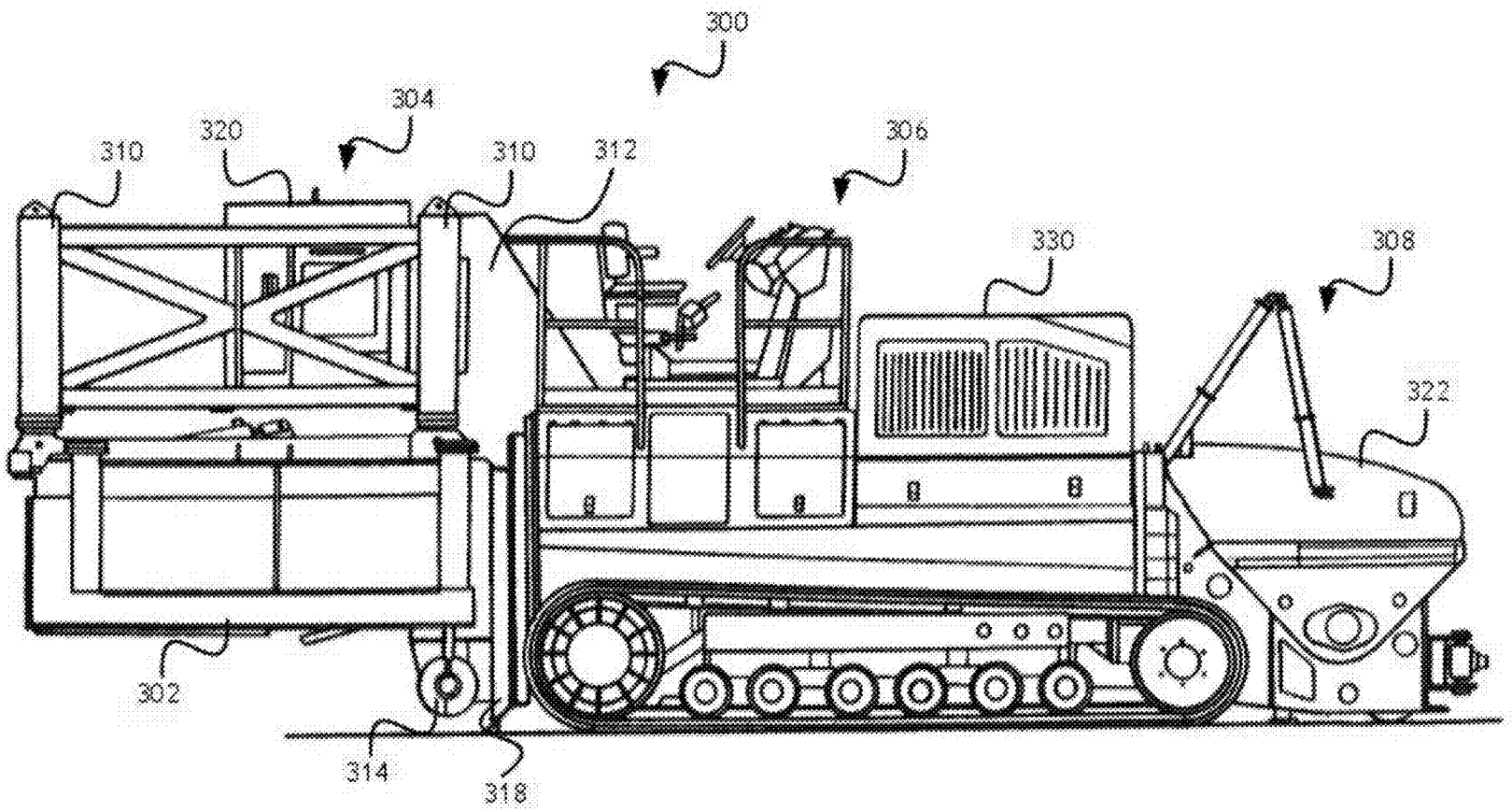
FIG. 3 shows a side elevation view of an embodiment of a concrete whitetopping system according to the present invention with the mold raised.

Referring to FIG. 3, a side elevation view of an embodiment of a concrete whitetopping system according to the present invention with the mold raised is shown. In at least one embodiment, a concrete whitetopping system 300 may include a mold 302 whose position/orientation may be controlled, through a control unit 320, by a mold positioning system 304 coupled to the mold 302. The mold positioning system 304 may include one or more controllable positioning elements 310 for controlling a position and orientation of the mold 302 with respect to the surface to be paved. In at least one embodiment, the concrete whitetopping system 300 may be placed in a transport position wherein the mold 302 is completely raised. When in the transport position, each of the positioning elements 310 of the mold positioning system 304 may be fully retracted, such that the mold 302 is completely raised. A transport unit 306 coupled to the mold positioning system 304 is coupled via one or more mold connecting elements 312, may transport the mold positioning system 304 while in the transport position. The transport unit 306 may include a power element 330 for powering the mobility of the transport unit 306, and in some cases hydraulic actuators of the concrete whitetopping system 300.

In addition, the concrete whitetopping system 300 may include a front bucket 308 including a hopper 322. In at least one embodiment, the front bucket 308 may be raised to a transport position.

In the transport position, a distribution apparatus, such as an auger 314 for distributing paving material across the width of the mold 302, may be exposed. Furthermore, a flow control member 318 for controlling the distribution of the paving material in the forward direction may be exposed. In a particular embodiment, the position of the flow control member 318 is controllable (e.g., via hydraulic control or the like) such that the flow control member 318 contacts the surface to be paved during use but is retracted while in the transport position.

Figure 4:
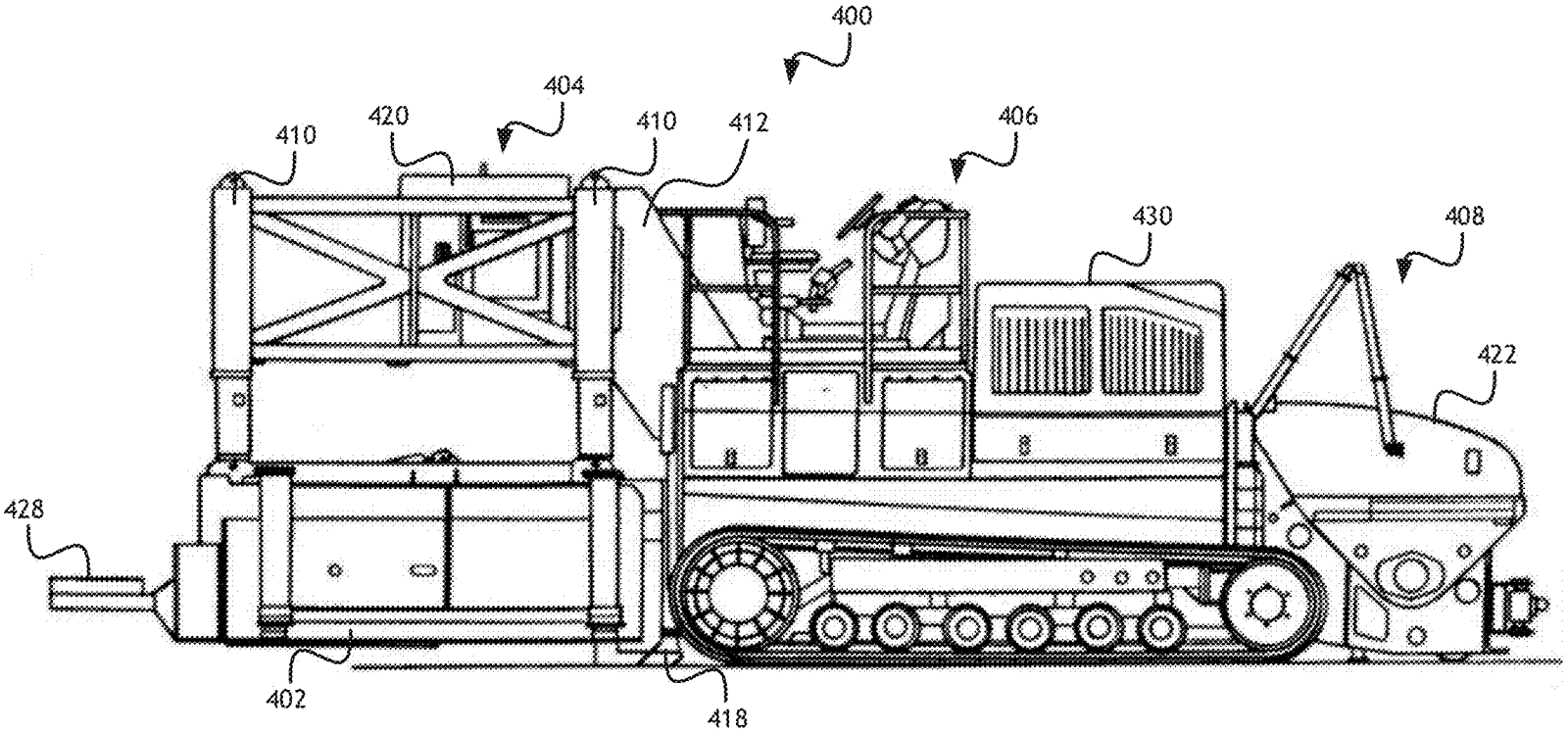
FIG. 4 shows a side elevation view of an embodiment of a concrete whitetopping system according to the present invention with the mold lowered.

Referring to FIG. 4, a side elevation view of an embodiment of a concrete whitetopping system according to the present invention with the mold lowered is shown. In at least one embodiment, a concrete whitetopping system 400 may include a mold 402 whose position/orientation may be controlled, through a control unit 420, by a mold positioning system 404 coupled to the mold 402. The mold positioning system 404 may include one or more controllable positioning elements 410 for controlling a position and orientation of the mold 402 with respect to the surface to be paved. In at least one embodiment, the concrete whitetopping system 400 may be placed in a paving position wherein the mold 402 is lowered to form a barrier with the surface being paved. When in the paving position, each of the positioning elements 410 of the mold positioning system 404 may be extended according to a design profile and potentially surface measurements from one or more sensors, such that the mold 402 is configured to form barrier for setting up concrete or other paving material as defined by a paving profile. A transport unit 406 coupled to the mold positioning system 404 is coupled via one or more mold connecting elements 412, may drive the mold positioning system 404 along a paving track as defined by the paving profile. The transport unit 406 may include a power element 430 for powering the mobility of the transport unit 406, and in some cases hydraulic actuators of the concrete whitetopping system 400.

In addition, the concrete whitetopping system 400 may include a front bucket 408 including a hopper 422. While in a paving position, the hopper 422 may be configured to receive a paving material for delivery to the mold 402. Within the mold 302, a flow control member 318 for controlling the distribution of the paving material may contact the surface to be paved during use. By contacting the surface, the flow control member may form a seal with the surface to prevent the paving material from being distributed too far forward and contacting a portion of the transport unit 306.

Figure 5:
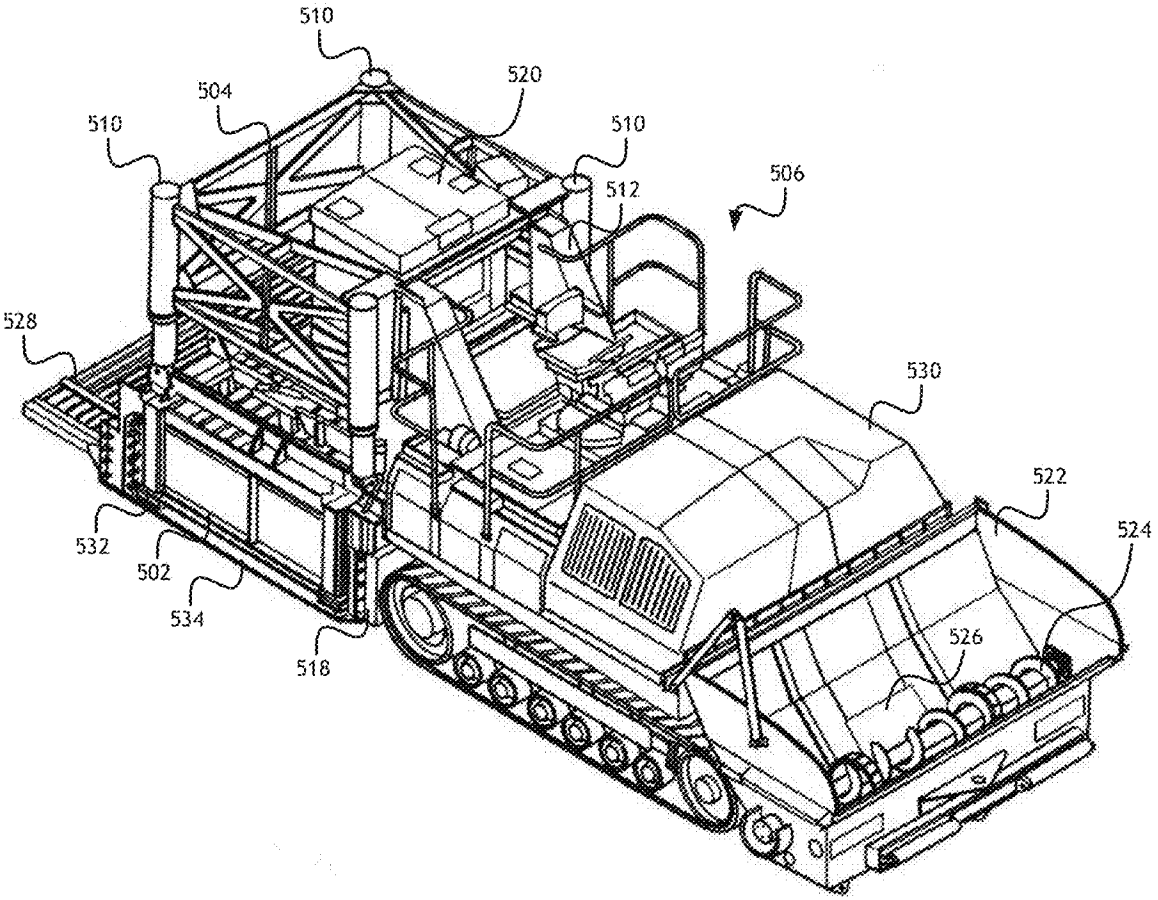
FIG. 5 shows an isometric view of an embodiment of a concrete whitetopping system according to the present invention.
Figure 6:
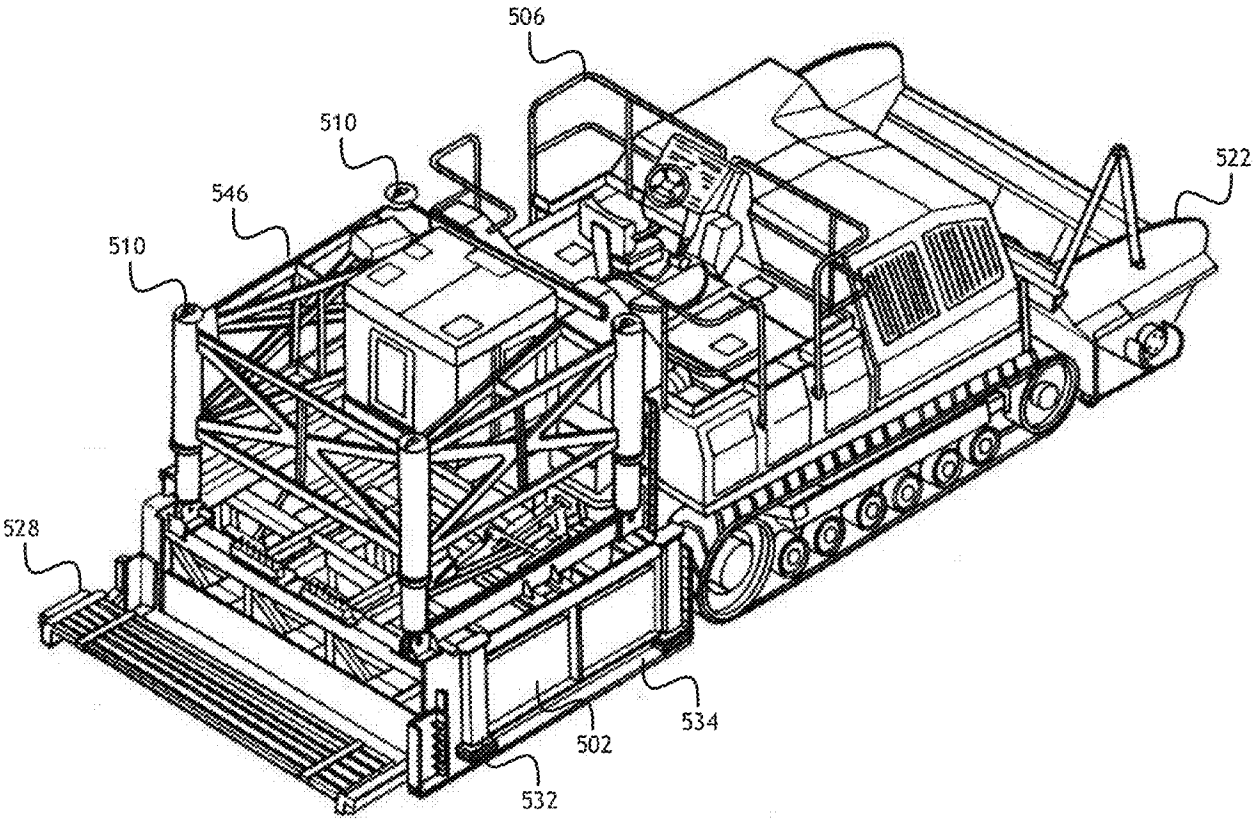
FIG. 6 shows another isometric view of an embodiment of a concrete whitetopping system according to the present invention.

Referring to FIGS. 5 and 6, isometric views of an embodiment of a concrete whitetopping system according to the present invention are shown. In at least one embodiment, a concrete whitetopping system 500 may include a mold 502 whose position/orientation may be controlled, through a control unit 520, by a mold positioning system 504 coupled to the mold 502. The mold positioning system 504 may include one or more controllable positioning elements 510 for controlling a position and orientation of the mold 502 with respect to the surface to be paved. Furthermore, the mold 502 may include finely adjustable mold barriers 534 that may be adjusted up or down via finely adjustable barrier actuators 532. While the one or more controllable positioning elements 510 are shown substantially at the periphery of the mold 502, the positioning elements 510 may be connected to any portion of the mold 502 suitable for adjusting the orientation of the mold 502 as more fully defined herein. Where the surface to be paved includes variations, such variations may be accounted for by adjusting the height of the mold barriers 534 continuously during paving.

The concrete whitetopping system 500 may also include a transport unit 506 with a power element 530, to which the mold positioning system 504 is coupled, and a front bucket 508 with an auger 524 for receiving a paving material and direct it toward a conveyor opening 526. Operation of the concrete whitetopping system 500 may include receiving a paving material (e.g., concrete) via the front bucket 508, transporting the paving material via a belt underneath the transport unit 506 to the mold 502, where the paving material may be placed and formed. The positioning of the front bucket 508 at the front of the transport unit 506 and of the mold 502 and mold positioning system 504 at the back of the transport unit, the concrete whitetopping system may generally avoid occupying lateral space around the surface to be paved. Such a configuration may permit paving of a surface with minimum clearance on the sides of the concrete whitetopping system 500.

The mold positioning system 504 may include one or more controllable positioning elements 510 for controlling a position and orientation of the mold 502 with respect to the surface to be paved. The mold positioning system 504 may be coupled to the transport unit 506 via a rigid mold connecting element 512. In at least one embodiment, the mold connecting element 512 may be rigid such that the position of at least a portion of the mold positioning system 504 remains constant relative to the transport unit 506, with the mold 502 being moveable relative to each of the mold positioning system 504 and the transport unit 506 via the positioning elements 510.

The mold positioning system 504 or mold 502 may also include a worker support platform 528. The worker support platform 528 may provide a surface upon which individuals may be supported above the freshly paved surface while working with the concrete whitetopping system 500 and/or the paved surface while the paving material is in a plastic state. Furthermore, instruments may be affixed to the worker support platform 528 for scanning the newly paved surface for defects.

Figure 7:
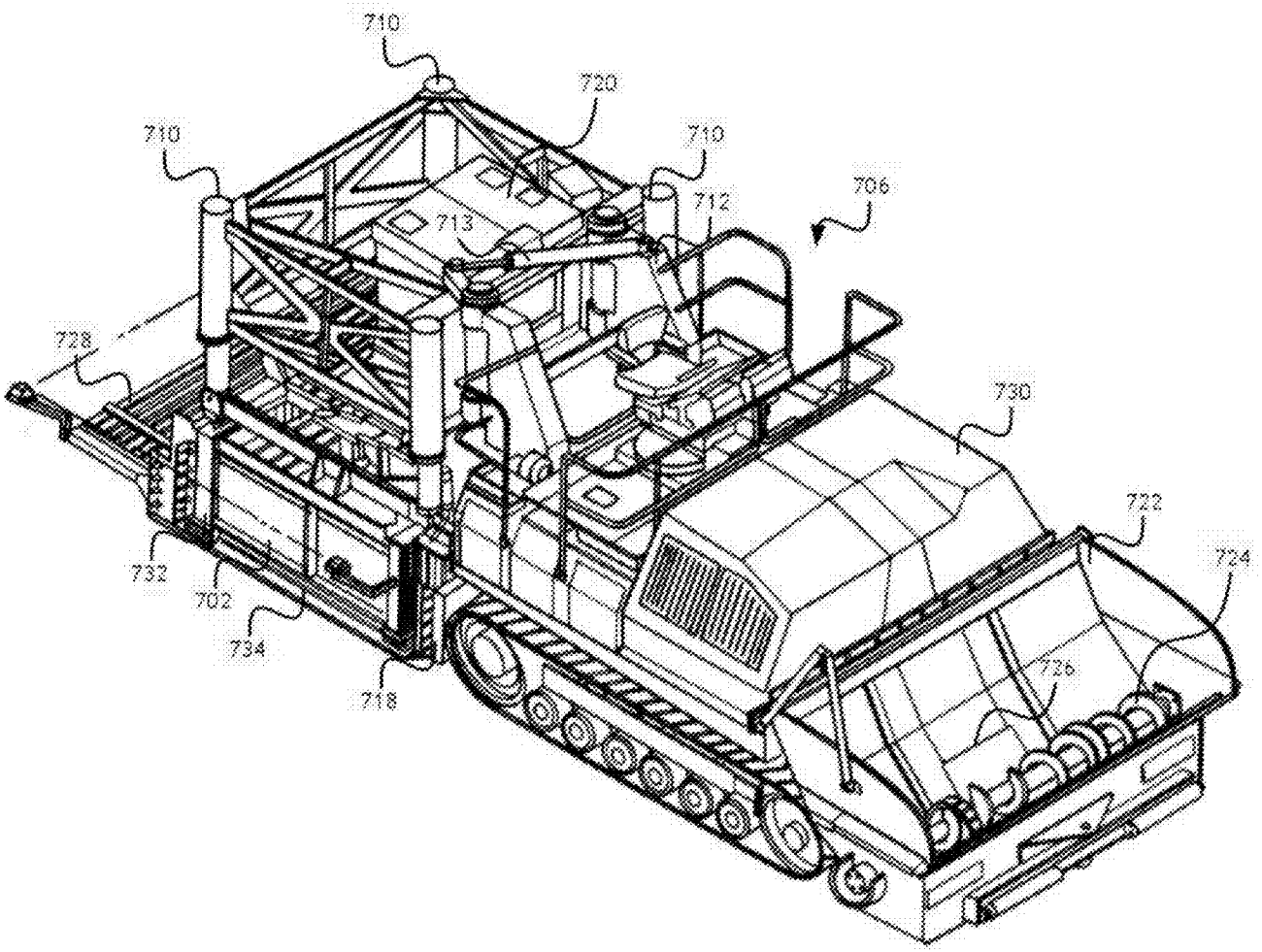
FIG. 7 shows an isometric view of an embodiment of a concrete whitetopping system according to the present invention.

Referring to FIG. 7, an isometric view of an embodiment of a concrete whitetopping system according to the present invention is shown. In at least one embodiment, a concrete whitetopping system 700 may include a mold 702 whose position/orientation may be controlled, through a control unit 720, by a mold positioning system 704 coupled to the mold 702. The mold positioning system 704 may include one or more controllable positioning elements 710 for controlling a position and orientation of the mold 702 with respect to the surface to be paved. Furthermore, the mold 702 may include finely adjustable mold barriers 734 that may be adjusted up or down via finely adjustable barrier actuators 732. Where the surface to be paved includes variations, such variations may be accounted for by adjusting the height of the mold barriers 734 continuously during paving.

The concrete whitetopping system 700 may also include a transport unit 706 with a power element 730, to which the mold positioning system 704 is coupled, and a front bucket 708 with an auger 724 for receiving a paving material and direct it toward a conveyor opening 726. Operation of the concrete whitetopping system 700 may include receiving a paving material (e.g., concrete) via the front bucket 708, transporting the paving material via a belt underneath the transport unit 706 to the mold 702, where the paving material may be placed and formed. The positioning of the front bucket 708 at the front of the transport unit 706 and of the mold 702 and mold positioning system 704 at the back of the transport unit, the concrete whitetopping system may generally avoid occupying lateral space around the surface to be paved. Such a configuration may permit paving of a surface with minimum clearance on the sides of the concrete whitetopping system 700.

The mold positioning system 704 may include one or more controllable positioning elements 710 for controlling a position and orientation of the mold 702 with respect to the surface to be paved. The mold positioning system 704 may be coupled to the transport unit 706 via an adjustable mold connecting element 712. In at least one embodiment, the mold connecting element 712 may comprise a pivoting assembly to allow the mold positioning system 704 to move within a limit range, in a plane substantially parallel to the surface being paved. The mold connecting element 712 may comprise one or more actuators 713 such as hydraulic pistons to adjust and control the orientation of the mold positioning system 704 within the plane. Such control and adjustment may be determined with reference to a previously positioned stringline, with reference to a paving profile, with reference to the movement track of the transport unit 106, with reference to one or more location markers such as total stations or GPS signals, or any other relevant reference points such that the mold positioning system 704 may smoothly follow a defined path having a certain minimum radius depending on the maximum deflection of the mold connecting element 712. Alternatively, the control unit 720 may control the one or more actuators 713 of the mold connecting element 712 to pivot independently of the transport unit 706 to facilitate variable radius paving according to a design profile.

The mold positioning system 704 or mold 702 may also include a worker support platform 728. The worker support platform 728 may provide a surface upon which individuals may be supported above the freshly paved surface while working with the concrete whitetopping system 700 and/or the paved surface while the paving material is in a plastic state. Furthermore, instruments may be affixed to the worker support platform 728 for scanning the newly paved surface for defects.

Figure 8:
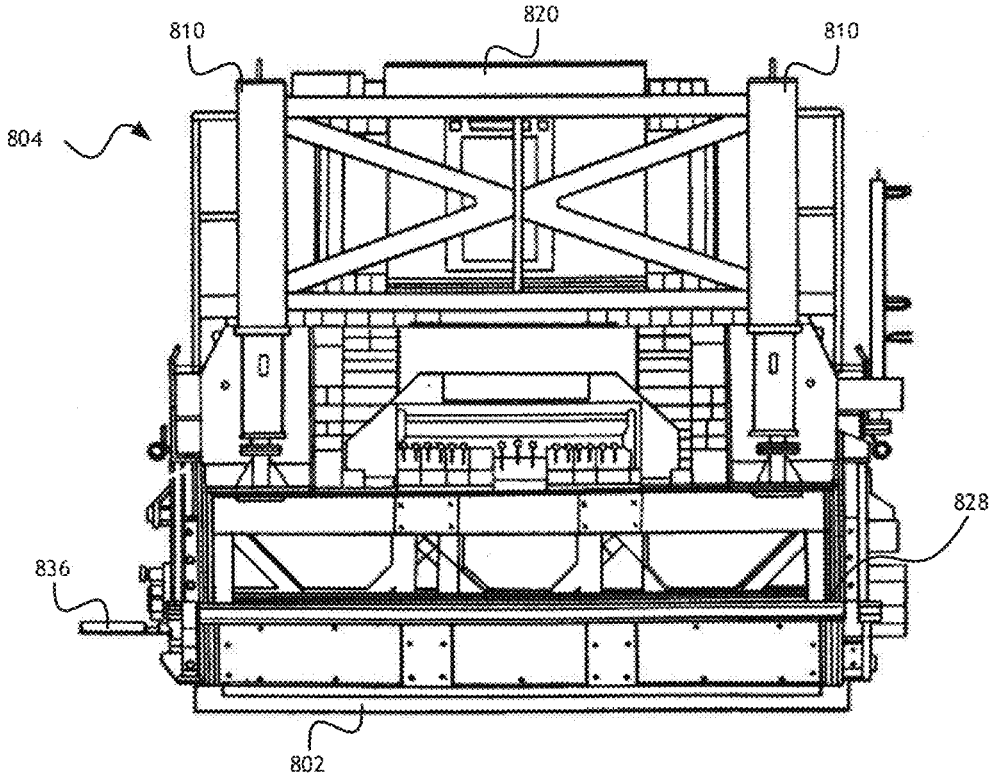
FIG. 8 shows a rear elevation view of an embodiment of a concrete whitetopping system according to the present invention.

Referring to FIG. 8, a rear elevation view of an embodiment of a concrete whitetopping system according to the present invention is shown. In at least one embodiment, a concrete whitetopping system 800 may include a mold 802 whose position/orientation may be controlled, through a control unit 820, by a mold positioning system 804 coupled to the mold 802. The mold positioning system 804 may include one or more controllable positioning elements 810 for controlling a position and orientation of the mold 802 with respect to the surface to be paved.

The mold positioning system 804 or mold 802 may also include a worker support platform 828. The worker support platform 828 may provide a surface upon which individuals may be supported above the freshly paved surface while working with the concrete whitetopping system 800 and/or the paved surface while the paving material is in a plastic state. Furthermore, instruments may be affixed to the worker support platform 828 for scanning the newly paved surface for defects. Likewise, instruments may be affixed to a lateral instrument platform 836 connected to the mold 802.

Figure 9:
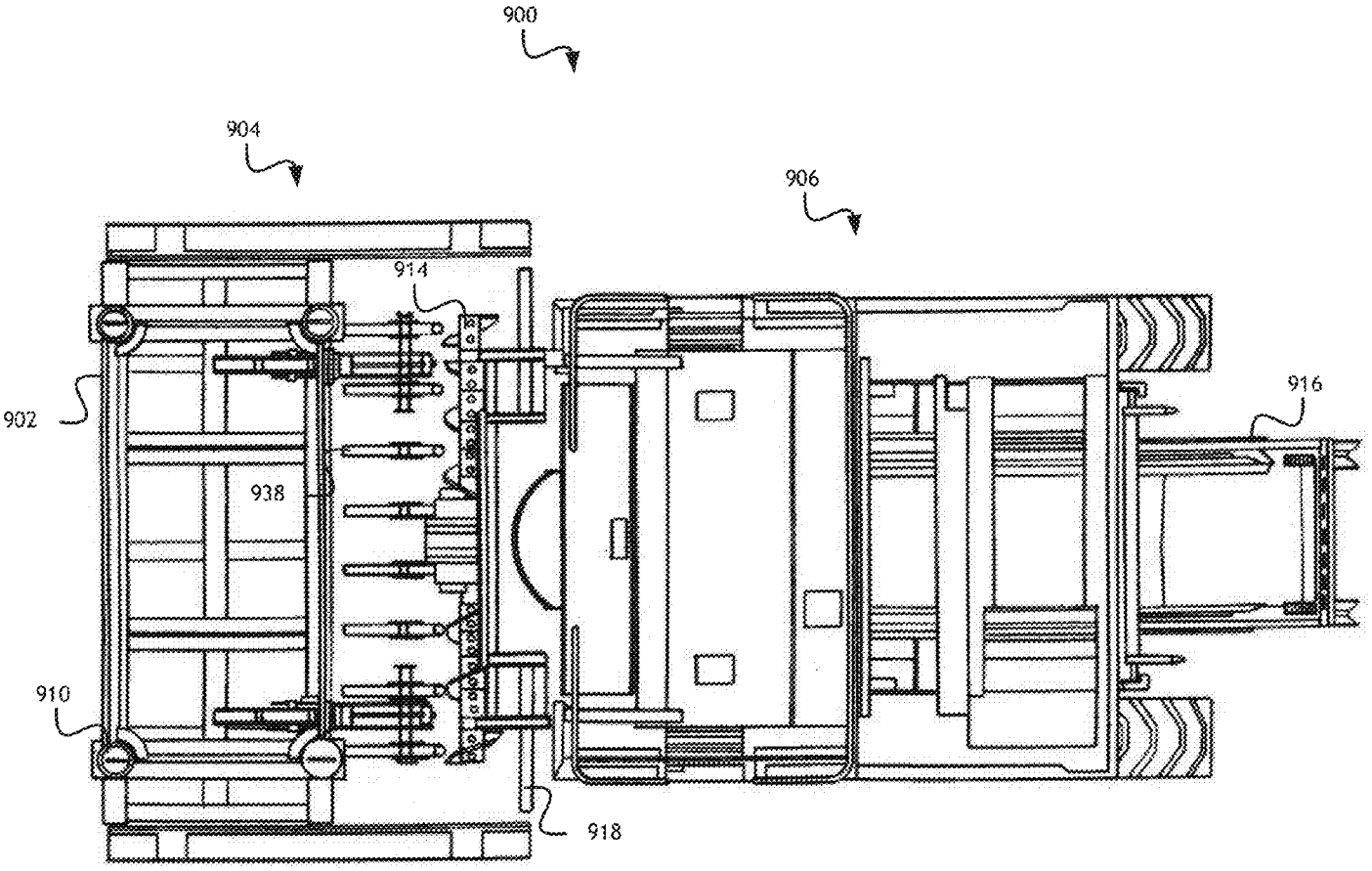
FIG. 9 shows a top view of a portion of an embodiment of a concrete whitetopping system according to the present invention.

Referring to FIG. 9, a top view of a portion of an embodiment of a concrete whitetopping system according to the present invention is shown. In at least one embodiment, a concrete whitetopping system 800 may include a mold positioning system 804 coupled to the mold 802. The mold 902 may include a system for distributing the paving material received from a front bucket across the width of the mold 902 (where the width of the mold 902 may be considered to be generally perpendicular to the direction of travel of the concrete whitetopping system 900). For instance the mold 902 may include an auger 914 configured to receive paving material from a conveyor system 916, such as conveyor belt, coupled between the front bucket (not shown) and the mold 902. The conveyor system 916 may be positioned substantially underneath a transport unit 906, such that when the front bucket receives paving material from a paving material source (e.g., a concrete mixer), the material is transported to the mold 902 via the conveyor system 916 underneath the transport unit 906. The auger 914 may be positioned substantially forward (relative to the direction of travel of the concrete whitetopping system 900) in the mold 902 in order to distribute the paving material toward the front of the mold 902. The conveyor system 916 and the system for distributing the paving material across the width of the mold 902 permits a paving material source to be located in front of the concrete whitetopping system 900, rather than occupying the lateral space around the surface to be paved. Since the transport unit 906 is positioned in front of the mold 902, it may be undesirable to deposit the paving material directly onto the surface to be paved, as the transport unit would contact the deposited material prior to being formed by the mold 902. Furthermore, the mold positioning system 904 may include a flow control member 918 for controlling the distribution of the paving material in the forward direction.

The concrete whitetopping system 900 may include vibrators 9 38 located in the mold 902 to agitate and remove air bubbles from the paving material.

It is believed that the present invention and many of its attendant advantages will be understood by the foregoing description of embodiments of the present invention, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A system, comprising:

a mold configured for forming a paving material into a slab upon a surface, the mold including a width that is substantially perpendicular to a direction of travel of the mold;

a computerized mold positioning system coupled to the mold, the computerized mold positioning system configured for controlling a position and orientation of the mold above the surface, the computerized mold positioning system including a plurality of actuators coupled to the mold, at least one of the plurality of actuators configured to adjust a height of the mold above the surface, and at least one of the plurality of actuators configured to adjust the orientation of the mold in a plane substantially parallel to the surface; and a transport unit configured for providing transport on the surface, the transport unit connecting the transport unit to the computerized mold positioning system at a rear portion of the transport unit, wherein:

the width of the mold is substantially greater than or equal to a maximum width of the transport unit such that the mold encompasses an area previously traversed by all wheels or treads of the transport unit; and the computerized mold positioning system is configured to:

receive a design profile of a paving surface; and actuate the at least one actuator configured to adjust the orientation of the mold in the plane substantially parallel to the surface to pivot independently of the transport unit and follow a variable radius path according to the design profile.

2. The system of claim 1, wherein the paving material comprises concrete.

3. The system of claim 1, wherein the mold includes an auger configured to receive the paving material from a conveyor portion and distribute the paving material across the width of the mold.

4. The system of claim 3, further comprising:

a flow control member adjacent the auger, the flow control member configured to contact the surface to form a barrier to flow of the paving material in the direction of the transport unit.

5. The system of claim 1, wherein the computerized mold positioning system is configured to control at least one of a long slope or a cross slope of the mold relative to the surface via at least one of the plurality of actuators.

6. The system of claim 1, wherein a thickness of the slab is controlled by a height of the mold above the surface, and wherein the height of the mold is directly controlled by the plurality of positioning elements actuators of the computerized mold positioning system.

7. The system of claim 1, wherein the computerized mold positioning system is configured to pivot the mold within the plane substantially parallel to the surface to maintain the computerized mold positioning system along a path defined by the transport unit.

8. A concrete paving apparatus comprising:

a mold configured for forming a paving material into a slab upon a surface, the mold including a width that is substantially perpendicular to a direction of travel of the mold;

a computerized mold positioning system coupled to the mold, the computerized mold positioning system configured for controlling a position and orientation of the mold above the surface, the computerized mold positioning system including a plurality of actuators coupled to the mold, at least one of the plurality of actuators configured to adjust a height of the mold above the surface, and at least one of the plurality of actuators configured to adjust the orientation of the mold in a plane substantially parallel to the surface; and a transport unit configured for providing transport on the surface, the transport unit connecting the transport unit to the computerized mold positioning system at a rear portion of the transport unit, wherein:

the width of the mold is substantially greater than or equal to a maximum width of the transport unit such that the mold encompasses an area previously traversed by all wheels or treads of the transport unit; and the computerized mold positioning system is configured to:

receive a design profile of a paving surface; and actuate the at least one actuator configured to adjust the orientation of the mold in the plane substantially parallel to the surface to pivot independently of the transport unit and follow a variable radius path according to the design profile.

9. The apparatus of claim 8, further comprising a flow control member disposed substantially between the transport unit and the mold, said flow control member configured to form a forward portion of the mold and prevent paving material flow toward the transport unit.

10. The apparatus of claim 9, further comprising a flow control actuator configured to adjust the height of the flow control member relative to the surface.

11. The apparatus of claim 8, wherein the computerized mold positioning system is configured to control at least one of a long slope or a cross slope of the mold relative to the surface via at least one of the plurality of actuators.

12. The apparatus of claim 8, further comprising one or more instrument mounting surfaces, said one or more instrument mounting surfaces configured to provide a known location for one or more sensors in data communication with the computerized mold positioning system.

13. The apparatus of claim 8, wherein the computerized mold positioning system further comprises a plurality of spatial locating elements disposed on known locations of the computerized mold positioning system, mold, and transport unit.

14. The apparatus of claim 8, wherein the computerized mold positioning system is configured to pivot the mold within the plane substantially parallel to the surface to maintain the computerized mold positioning system along a path defined by a paving profile, said path being independent of a path defined by the transport unit.

15. A concrete paving apparatus comprising:

a mold configured for forming a paving material into a slab upon a surface, the mold including a width that is substantially perpendicular to a direction of travel of the mold;

a computerized mold positioning system coupled to the mold, the computerized mold positioning system configured for controlling a position and orientation of the mold above the surface, the computerized mold positioning system including a plurality of actuators coupled to the mold, at least one of the plurality of actuators configured to adjust a height of the mold above the surface, and at least one of the plurality of actuators configured to adjust the orientation of the mold in a plane substantially parallel to the surface; and a transport unit configured for providing transport on the surface, the transport unit connecting the transport unit to the computerized mold positioning system at a rear portion of the transport unit, wherein:

the width of the mold is substantially greater than or equal to a maximum width of the transport unit such that the mold encompasses an area previously traversed by all wheels or treads of the transport unit; and the computerized mold positioning system is configured to:

receive a design profile of a paving surface; and actuate the at least one actuator configured to adjust the orientation of the mold in the plane substantially parallel to the surface to pivot independently of the transport unit and follow a variable radius path according to the design profile.

* * * * *